US005515586A

United States Patent [19]

Menegatto

[11] Patent Number: 5,515,586

[45] Date of Patent: May 14, 1996

[54] TEXTILE MACHINE FOR TEXTURING YARN BY THERMOPLASTIC DEFORMATION

[75] Inventor: Carlo Menegatto, Monza, Italy

[73] Assignee: Menegatto S.r.l., Milan, Italy

[21] Appl. No.: 363,526

[22] Filed: Dec. 23, 1994

[30] Foreign Application Priority Data

Dec. 24, 1993 [IT] Italy ..... MI93A2730

[51] Int. Cl.[6] ..... D02G 1/00

[52] U.S. Cl. ..... 28/247

[58] Field of Search ..... 28/240, 246, 247, 28/248, 249, 256; 57/290, 291, 281, 288, 287

[56] References Cited

FOREIGN PATENT DOCUMENTS 281657 9/1988 European Pat. Off. .

330368 8/1989 European Pat. Off. .

419815 4/1991 European Pat. Off. .

*Primary Examiner*—C. D. Crowder

*Assistant Examiner*—Larry D. Worrell,Jr.

*Attorney, Agent, or Firm*—Young & Thompson

[57] ABSTRACT

A texturing machine has a main framework defining a creel for supporting feed reels of yarn to be processed and a support structure for collection assemblies for textured yarn. The creel and the structure for supporting the yarn collection assemblies are opposite to and distanced one from the other to define an intermediate transit corridor. The texturing machine also has a yarn texturing device supported by the main framework and arranged alongside the creel on its side facing the structure for supporting the collection assemblies.

7 Claims, 1 Drawing Sheet

TEXTILE MACHINE FOR TEXTURING YARN BY THERMOPLASTIC DEFORMATION

BACKGROUND OF THE INVENTION

1. Field of the Invention

The present invention relates to a textile machine for the texturing of yarn by twisting thermoplastic deformation.

With this machine the yarn to be processed, consisting of so many parallel filaments, is deformed plastically so that the latter tangle and join one to the other.

To summarize, the texturing operation consists of heating the yarn filaments to soften them slightly and of subjecting them, in this "pasty" state, to twisting followed immediately by counter-twisting so as to cause permanent plastic deformation of the yarn filaments to allow tangling and binding of the filaments one with the other. This double operation of twisting and untwisting performed on the yarn is defined by those skilled in the art as "false twisting".

2. Description of the Related Art

The known texturing machines of the type referred above are generally divided into a first type of machine having one single yarn heating oven for true and proper texturing, i.e. for subjecting said yarn to the abovementioned false twisting, intended to texture for example a material such as nylon, and machines of a second type, intended to texture for example a material such as polyester, which in addition to the first texturing oven have a second oven for stabilizing the elastic properties of the yarn, that is to say for heating the yarn in order to eliminate its excessive elastic tensile deformability.

The machines of the first type essentially comprise a main support framework which defines a creel for supporting feed reels of the yarn to be processed and a support structure for the collection assemblies of the textured yarn, wherein the creel and the support structure of the yarn collection assemblies are arranged and distanced one from the other so as to define an intermediate transit corridor for staff in charge. The texturing machine also comprises yarn texturing means which comprise essentially, in sequence: a part for removing the yarn to be textured coming from the creel area, said texturing oven for heating the yarn to be textured, a channel for cooling the heated yarn which emerges from said texturing oven, a texturing spindle—that is to say a device suitable for causing the required twisting and untwisting of the yarn, and a part for removing the textured yarn.

In known texturing machines the arrangement of the elements which make up the machine, that is to say the creel of the collection assemblies and the texturing means, poses a problem from at least two different viewpoints.

According to a first point of view, texturing machines are built in order to economize as far as possible on the space occupied by said machine, for example attempts are made to restrict to a maximum the width of the intermediate transit corridors. Moreover, from another viewpoint, the need has been felt to bring the parts for actual texturing into a position with immediate access for staff, both in order to perform operations of maintenance and replacement of pads, and to trigger the spinning operation, which requires the operator to force the passage of the yarn inside all the operative elements of the texturing machine. The latter operation in particular, the texturing machines provided being arranged adjacent in long rows which may also contain several hundreds of machines, requires several hours of work by the operator, so that the need has been felt, in order to make savings in labor terms, to have all the elements wherein the yarn has to be passed within reach, without said operator being forced to move continually from the intermediate corridor to the back of the machine or to have to remain in poorly accessible positions, raised or inside moving machinery which above all may create a dangerous situation for the safety of the same operator.

The texturing machines of the second type comprise, in addition to the abovementioned elements and in series with said texturing means, yarn stabilization means aimed at fixing the length of the yarn, essentially comprising the abovementioned second heating oven and a part for removing the yarn which comes out of said second oven.

In texturing machines known to date said texturing means are arranged in a higher position in relation to the creel and to the textured yarn collection assembly, in a position with poor access for staff. They also extend from the creel to the yarn collection assembly in such a way as to force, due to their considerable development lengthwise, the yarn collection assembly and said creel to be maintained excessively apart one from the other.

Moreover in known machines the second oven for fixing the yarn is generally arranged vertically and in a closed station provided on the back of the collection assembly such as to make said yarn fixing oven poorly accessible to staff. Said known machines therefore have excessive overall dimensions and an awkward and dangerous arrangement of the yarn stabilization and texturing elements.

Another disadvantage demonstrated by known texturing devices consists in the fact that the yarn therein is generally made to follow a winding path with a large number of acute drive angles, wherein the yarn is stressed due to the high tensions whereto it is subjected, involving a risk of breakage or damage of the yarn itself.

SUMMARY OF THE INVENTION

The object of the present invention is to provide a texturing machine, which has limited overall dimensions and improved accessibility of the working components.

Another object of the present invention is that of providing a texturing machine wherein the number of acute angles which the yarn has to perform are reduced to a minimum so as to lower the risk of breakage or damage of the yarn itself.

The previous objects are achieved essentially with a texturing machine that comprises a main support framework defining a creel for the support of the feed reels of the yarn to be processed and a support structure for collection assemblies for the textured yarn, wherein said creel and said structure for supporting the yarn collection assemblies are opposite to and distanced one from the other to define an intermediate transit corridor, said texturing machine also comprising, supported by said frameworks, yarn texturing means of the type comprising, in sequence, a part for removing the yarn to be textured coming from the creel area, a texturing oven for heating said yarn, a channel for cooling the heated yarn exiting said texturing oven, a texturing spindle suitable for causing the required twisting and untwisting of the yarn, and a part for removing said textured yarn, and is characterized in that said yarn texturing means are arranged alongside said creel on the side of the latter which faces the structure for supporting the collection assemblies.

In this way the texturing machine according to the invention provides access for an operator, who is in said intermediate corridor, to all the components which make up said texturing means, allowing him to work comfortably without wasting time and avoiding the aforementioned risk situations.

Moreover according to the invention provision is made for arranging the abovementioned elements defining said texturing means substantially aligned one with the other to define a substantially rectilinear path of the yarn; this path allows most of the acute drive angles which are instead to be found in traditional texturing machines to be eliminated and the risk of breakage or damage of the yarn itself to be avoided.

BRIEF DESCRIPTION OF THE DRAWINGS

Further features and advantages of the present invention will in any case be made clearer on reading the following description relating to a particular embodiment of the invention.

DESCRIPTION OF PREFERRED EMBODIMENTS

Figure 1:
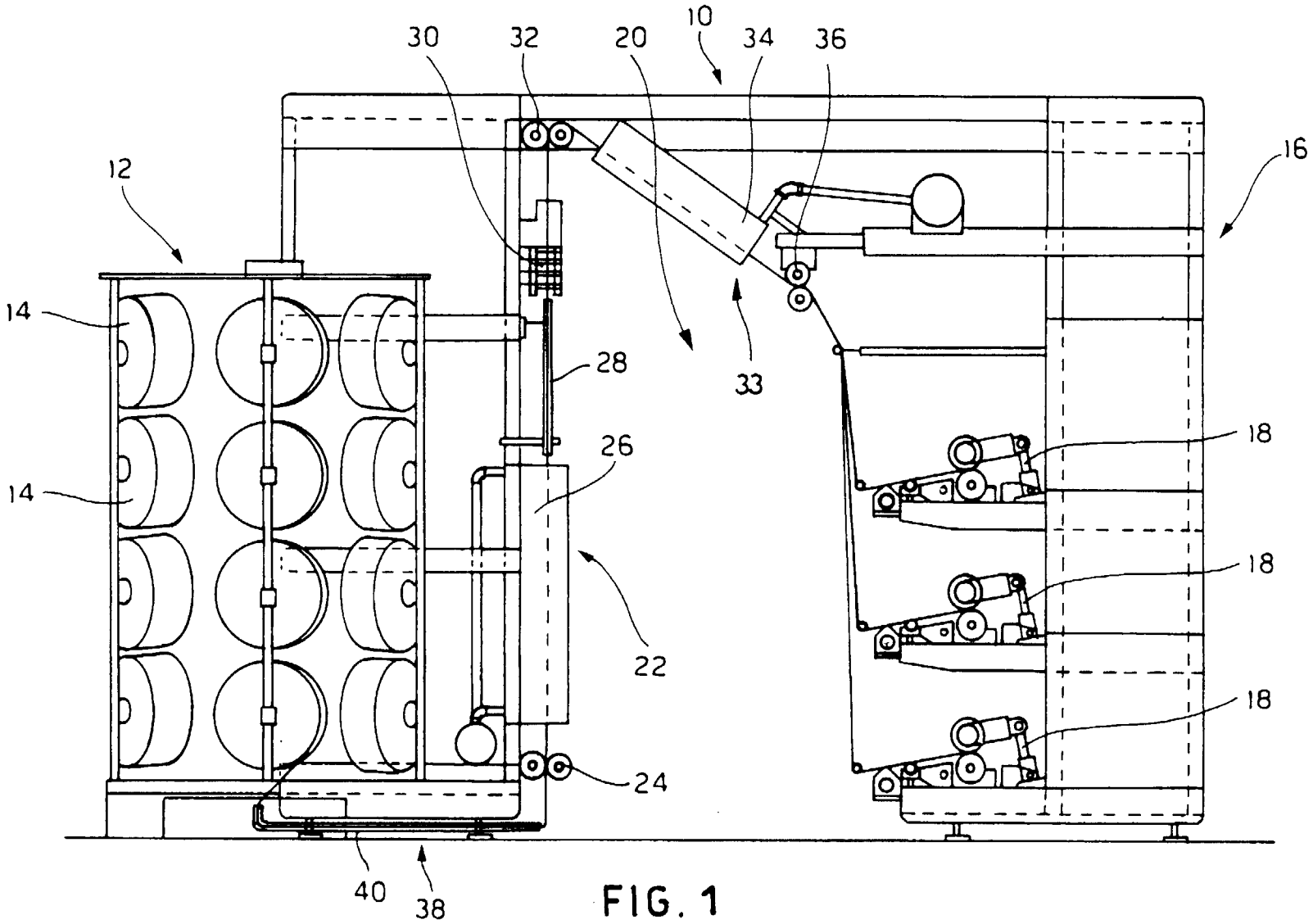
FIG. 1 shows a side view of the preferred embodiment of the texturing machine according to the present invention.

The preferred embodiment of the texturing machine shown in FIG. 1 of the accompanying drawing comprises a main framework 10 defining a creel 12 for supporting feed reels 14 of the yarn to be processed and a support structure 16 for textured yarn collection assemblies 18. Said creel 12 and said structure 16 for supporting the yarn collection assemblies 18 are opposite to and distanced one from the other so as to leave an intermediate transit corridor 20 for staff.

The texturing machine also comprises yarn texturing means 22 which comprise, in the following order, a first part 24 for removing the yarn to be textured in the form of opposite rotating shafts or rollers, a first texturing oven 26 for heating said yarn, said first oven 26 having to be opened by the operator to allow the yarn to pass through before the machine is started up, a channel 28 for cooling the heated yarn which comes out of said texturing oven, a texturing spindle 30 for the required twisting and untwisting of the softened yarn, and a second part 32 for removing the textured yarn consisting of opposite shafts or rollers.

As is known, the second removing part 32 withdraws the yarn at a speed greater than that of said first removing part 24 as, during the texturing operation, the yarn is also stretched, which subjects the same yarn to a situation of stress which, where there are acute drive angles, could cause it to break.

According to the invention, the abovementioned texturing elements are arranged substantially aligned one with the other to define a substantially rectilinear path of the yarn and to avoid the risks of breakages of the yarn itself. According to the invention the said texturing elements are also attached, independently one from the other, to said main framework, in a lateral position in relation to the creel on the side of the latter which faces the structure for supporting the collection assemblies, which allows easy access to all the components by the operator who can remain virtually at a standstill in the same position inside the transit corridors.

According to a further innovative feature of the texturing machine of the present invention the texturing means are fed with yarn which comes from below said creel, so that said components of the texturing means can be arranged, according to the sequence listed previously, from the bottom upwards with the yarn in output from said means which passes above said corridor so as not to obstruct the passage of the operator and possible mechanical vehicles.

Advantageously said aligned texturing means are then attached to said creel and arranged along a substantially vertical line. This alignment allows the width of the transit corridor to be limited to the required minimum for the movement of the operator. According to the invention it can however be foreseen to arrange the substantially aligned texturing means at a slant in relation to the vertical plane with a small angle, no larger in any case than 15°, as it is considered that with greater angles, in order to allow easy transit of the operator, the intermediate corridor has to be widened excessively, thus making the texturing machine too bulky in terms of width.

The texturing machine described hitherto is a machine which has been classified as the first type, that is to say suitable for treating nylon type yarn wherein the presence of a single yarn heating oven is sufficient for only performing texturing of the yarn. For other types of yarn, as has already been referred, such as for example polyester, the use is required of a second oven for stabilizing the yarn and for being suitable for eliminating the excessive tensile elasticity of a yarn of this type.

The accompanying drawing in FIG. 1 shows, in series with said texturing means, the presence of a stabilization means 33 comprising a second oven 34 for stabilizing the elasticity of the yarn and a third part 36 for removing the yarn coming out of said second oven 34, in the form of opposite shafts or rollers as for the previously mentioned first and second removing parts.

It is quite clear that the texturing machine, defined here as being of the first type, for the treatment of material such as nylon, does not have the said yarn stabilization means shown in FIG. 1 of the accompanying drawing; in this case, by replacing with a simple drive element the said third parts 36 for removing the stabilized yarn, said stabilization means would not be included and the yarn would maintain the same path shown in FIG. 1.

Advantageously according to the invention, said second fixing oven 34 attached at one end in a cantilevered manner to the main framework 10, is arranged above said intermediate transit corridor 20 between said creel 12 and said structure 16 for supporting said collection assemblies 18. In this way the operator can easily reach said oven 34 for performing the operations required, such as opening the oven for the yarn to pass through or assembling or disassembling the same oven, always remaining inside said intermediate corridor 20.

As is clear from FIG.1, said fixing oven 34 is also arranged tilting downwards with the third removing part 36 which is attached to said main framework 10 above said yarn collection assemblies, in a lower position in relation to the second part for removing the textured yarn 32, in such a way as to make the angle of drive of the third removing parts 36 towards said collection assemblies 18 obtuse. This arrangement prevents the yarn from being excessively stressed as, on coming out of the second oven 34, it is still hot and weakened as regards mechanical strength properties.

In order to guarantee easy access also to the third removing parts 36, the latter are attached onto said support framework on the side of said structure 16 for supporting the collection assemblies 18 which faces said creel 12.

Advantageously, for feeding from below the yarn coming from the creel 12 to said texturing means 22, a yarn transport channel 38 is also provided and attached below the creel 12 to extend from a central position of the creel 12 with a substantially horizontal branch 40 towards the intermediate corridor 20.

It is clear that, according to the present invention, the path of the yarn inside the working means of the texturing machine does not have virtually any acute drive angles, the only acute angle in the path of the yarn being provided at the second textured yarn removing parts 32 in a situation wherein the yarn can be placed over the driving roller, that has a considerable bending radius which does not in any way cause acute bending of the yarn, and can be simply and conveniently accompanied by the latter to be arranged along another angle without being subjected to those stresses which occur however at acute drive angles. Thus the number of occasions of stress to which the yarn is subjected is reduced in relation however to the situation in traditional texturing machines, lowering the risk of breakages or damage of the yarn and reducing the loss of quality and the depreciation of the yarn. A considerable reduction is also achieved in the number of reknotting operations on the broken yarn to be performed by operators in order to restore functioning of the machine, thus saving labor costs.

It is understood that what has been written and shown in FIG. 1 of the accompanying drawing with reference to the preferred embodiment of the texturing machine of the present invention has been given purely by way of an example of the inventive principle.

What is claimed is:

1. A texturing machine comprising:

a main framework (10);

a creel (12) attached to one side of the main framework (10);

a plurality of feed reels (14) supported on the creel (12);

a support structure (16) attached to an opposite side of the main framework (10);

a plurality of collection assemblies (18) mounted on the support structure (16);

an intermediate transit corridor (20) defined between the creel (12) and the support structure (16); and means (22), connected between the creel (12) and the main framework (10), for texturing yarn;

wherein said means (22) for texturing yarn includes:

a first part (24) for removing yarn from one of the plurality of feed reels (14);

a first oven (26) for heating the yarn;

a channel (28) for cooling the yarn;

a spindle (30) for twisting and untwisting the yarn; and a second part (32) for removing the yarn from the spindle (30);

wherein said means (22) for texturing yarn is arranged alongside the creel (12) in a substantially vertical line on an inner side of the intermediate transit corridor (20) facing the support structure (16) so that the first part (24), the first oven (26), the channel (28), the spindle (30), and the second part (32) are substantially aligned with one another in order to define a substantially rectilinear path for the yarn and to provide easy access to the yarn for an operator standing inside the intermediate transit corridor (20).

2. Texturing machine according to claim 1, wherein said yarn texturing means (22) is attached to the creel (12) along a line which tilts in relation to a vertical plane at an angle no greater than 15°.

3. Texturing machine according to claim 1, wherein said first part (24) for removing the yarn is attached to a lower area of said creel (12) and wherein the yarn is fed to said texturing means (22) from below said creel (12).

4. Texturing machine according to claim 3, wherein a channel means (38) for the transport of the yarn is provided from the lower area of the creel (12) to said yarn texturing means (22), attached to said creel (12) and having at least one horizontal branch (40) which extends below said creel (12).

5. Texturing machine according to claim 1, of the type wherein yarn stabilization means (33) are provided, in series with said yarn texturing means (22), including a second oven (34) for heating the yarn and a third part (36) for removing the yarn coming out of the second oven (34), wherein said yarn stabilization means (33) is arranged above the intermediate transit corridor (20), between said creel (12) and said support structure (16).

6. A texturing machine according to claim 5, wherein said third part (36) for removing the yarn is arranged at a side of said support structure (16) inside the intermediate transit corridor (20) which faces said creel (12).

7. Texturing machine according to claim 6, wherein said second oven (34) is arranged tilting downwards in relation to a horizontal plane, and said third part (36) for removing the yarn is attached to said main framework (10) above said collection assemblies (18) which are in a lower position.

* * * * *